US008277276B2

(12) United States Patent
Waitz et al.

(10) Patent No.: US 8,277,276 B2
(45) Date of Patent: Oct. 2, 2012

(54) BRASSIERE CUP WITH A BREAST ENHANCEMENT INSERT AND BRASSIERE FORMED THEREWITH

(75) Inventors: Sandra A. Waitz, New York, NY (US); Anthony J. Nuzzo, New York, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 1071 days.

(21) Appl. No.: 12/173,657

(22) Filed: Jul. 15, 2008

(65) Prior Publication Data

US 2010/0015886 A1 Jan. 21, 2010

(51) Int. Cl.
*A41C 3/00* (2006.01)

(52) U.S. Cl. ..... 450/57; 450/54; 450/39

(58) Field of Classification Search ..... 450/37–39, 450/54–58, 92, 93; 2/267, 268
See application file for complete search history.

(56) References Cited

U.S. PATENT DOCUMENTS

| | | | | |
|---|---|---|---|---|
| 2,041,066 | A * | 5/1936 | Priscilla | 450/56 |
| 2,342,076 | A * | 2/1944 | Herbener | 450/56 |
| 3,384,091 | A * | 5/1968 | Block | 450/54 |
| 3,814,107 | A | 6/1974 | Greenblatt et al. | |
| 3,834,397 | A | 9/1974 | Birch | |
| 4,816,004 | A | 3/1989 | Emanuel | |
| 5,098,330 | A | 3/1992 | Greenberg | |
| 5,334,082 | A | 8/1994 | Barker | |
| 6,015,332 | A | 1/2000 | Lee et al. | |
| 6,095,893 | A | 8/2000 | Lin | |
| 6,224,458 | B1 | 5/2001 | Chen | |
| 6,346,028 | B1 * | 2/2002 | Fildan et al. | 450/41 |
| 6,402,585 | B1 | 6/2002 | Gatto et al. | |
| 6,431,945 | B1 | 8/2002 | Stephens et al. | |
| 6,439,959 | B1 | 8/2002 | Magrone et al. | |
| 6,443,806 | B1 | 9/2002 | Fang | |
| 6,824,444 | B2 * | 11/2004 | Huang | 450/57 |
| 6,966,815 | B2 | 11/2005 | Weinerth | |
| 6,997,775 | B2 | 2/2006 | Jagaric et al. | |
| 7,044,829 | B1 | 5/2006 | Jagaric et al. | |
| 7,074,108 | B2 | 7/2006 | Knox | |
| 7,244,167 | B2 | 7/2007 | Falla | |
| 7,311,583 | B2 | 12/2007 | Jagaric et al. | |
| 7,556,553 | B2 * | 7/2009 | Falla et al. | 450/39 |
| 7,666,059 | B2 * | 2/2010 | Falla et al. | 450/39 |
| 7,722,432 | B2 * | 5/2010 | Wood et al. | 450/39 |
| 7,922,560 | B2 * | 4/2011 | Avalos-Dessner et al. | 450/39 |
| 2005/0277364 | A1 | 12/2005 | Redenius | |
| 2006/0166601 | A1 | 7/2006 | Chen | |
| 2007/0054597 | A1 | 3/2007 | Mone et al. | |

* cited by examiner

*Primary Examiner* — Gloria Hale
(74) *Attorney, Agent, or Firm* — Womble Carlyle Sandridge & Rice LLP

(57) ABSTRACT

A brassiere cup, and brassiere formed therewith, is provided for enhancing the shape of a wearer's breast. The brassiere cup comprises an outer fabric layer having a lower peripheral portion, and an inner liner fabric layer having a lower peripheral portion. A breast enhancement insert having upper and lower peripheral portions and inner and outer surfaces is attached along the lower peripheral portions of the outer fabric layer and the inner liner layer, the upper peripheral portion and the inner and outer surfaces of the insert being substantially unattached. The breast enhancement insert comprises a padding material encapsulated within a fabric cover.

32 Claims, 6 Drawing Sheets

BRASSIERE CUP WITH A BREAST ENHANCEMENT INSERT AND BRASSIERE FORMED THEREWITH

FIELD OF THE INVENTION

The invention generally relates to brassieres, and, more particularly, to a brassiere cup and brassiere formed therewith having a padded breast enhancement insert.

BACKGROUND

The desire to enhance the shape and size of the female breast is age-old. Responsive to this desire, brassiere makers have constructed numerous types and styles of brassieres having padded breast cups for breast enhancement. In one category, brassieres have been developed for women having small breasts and who wish to enlarge and enhance the appearance of their breasts without resorting to implants or other surgical procedures. The padding or molded foam layers, however, are often thick, bulky, and lack the desired degree of pliability and the appearance of real breasts.

To address this problem, underwires and frames have been incorporated into lighter-weight brassiere constructions, but these have failed to satisfactorily change the shape of the breasts. While uplifting, these constructions also have not enhanced the perceived size of the wearer's breasts.

Other attempts at breast enhancement have included the use of inserts within the breast cups. Where foam or other inserts have been attempted, they have either required special pockets on the insides of the cups, or have been laminated between bulky molded cups. These bulky cup constructions are not only thick, but also fail to provide a real breast-like appearance and feel desired by the wearer.

What is needed, therefore, is a brassiere cup construction that provides the desired lift and enhancement to the breast in a lightweight brassiere construction, which retains the real breast-like appearance.

Various features and aspects of the invention will become apparent upon review of the detailed description set forth below when taken in conjunction with the accompanying drawing figures, which are briefly described as follows.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

The present invention is directed to a brassiere cup, and to a brassiere formed therewith, which enhances the breast using a relatively lightweight brassiere construction.

Figure 1:
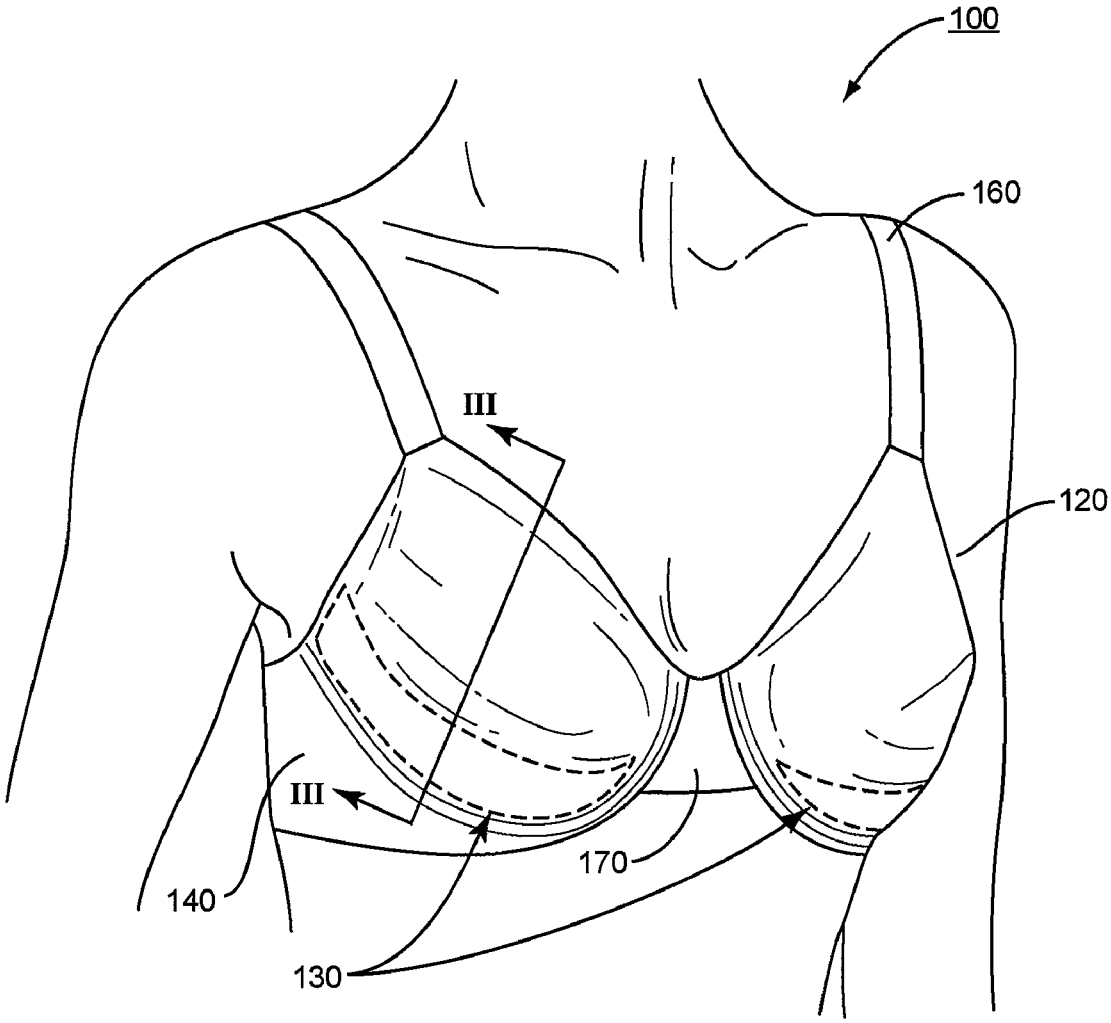
FIG. 1 is a front perspective view of a brassiere incorporating the breast enhancement insert of the present invention.
Figure 2:
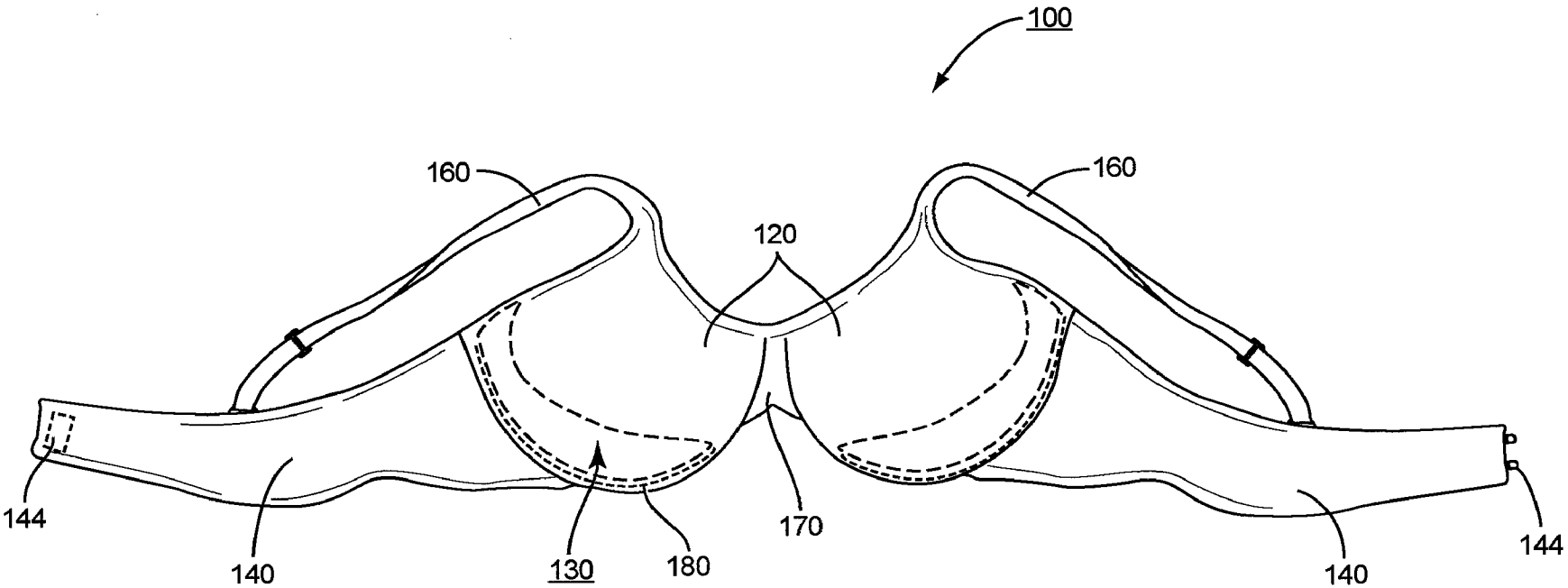
FIG. 2 is a rear perspective view of a brassiere incorporating the breast enhancement insert of the present invention.

Referring to the Figures in general, and to FIGS. 1 and 2 in particular, a brassiere constructed according to the present invention is shown generally as 100. As is conventional, the brassiere comprises a pair of breast receiving cups 120, discussed in greater detail below, a pair of backstraps 140, and a pair of shoulder straps 160. Each of the pair of backstraps 140 is connected to and extends outwardly from one of the breast receiving cups 120, and each of the pair of shoulder straps 160 connects one of the breast receiving cups 120 to one of the backstraps 140. As shown in the exemplary embodiment in FIG. 2, the breast cups are centrally connected to one another by means of a bridge 170. While the brassiere depicted in FIG. 2 has a rear closure, with conventional closure elements 144, such as hook and eye closures, the brassiere is not limited thereto; rather, numerous brassiere constructions are possible with the breast receiving cups 120 of the present invention. Thus, the brassiere could comprise a front closure (not shown), or could lack closures completely, such as a pullover athletic brassiere.

Figure 3:
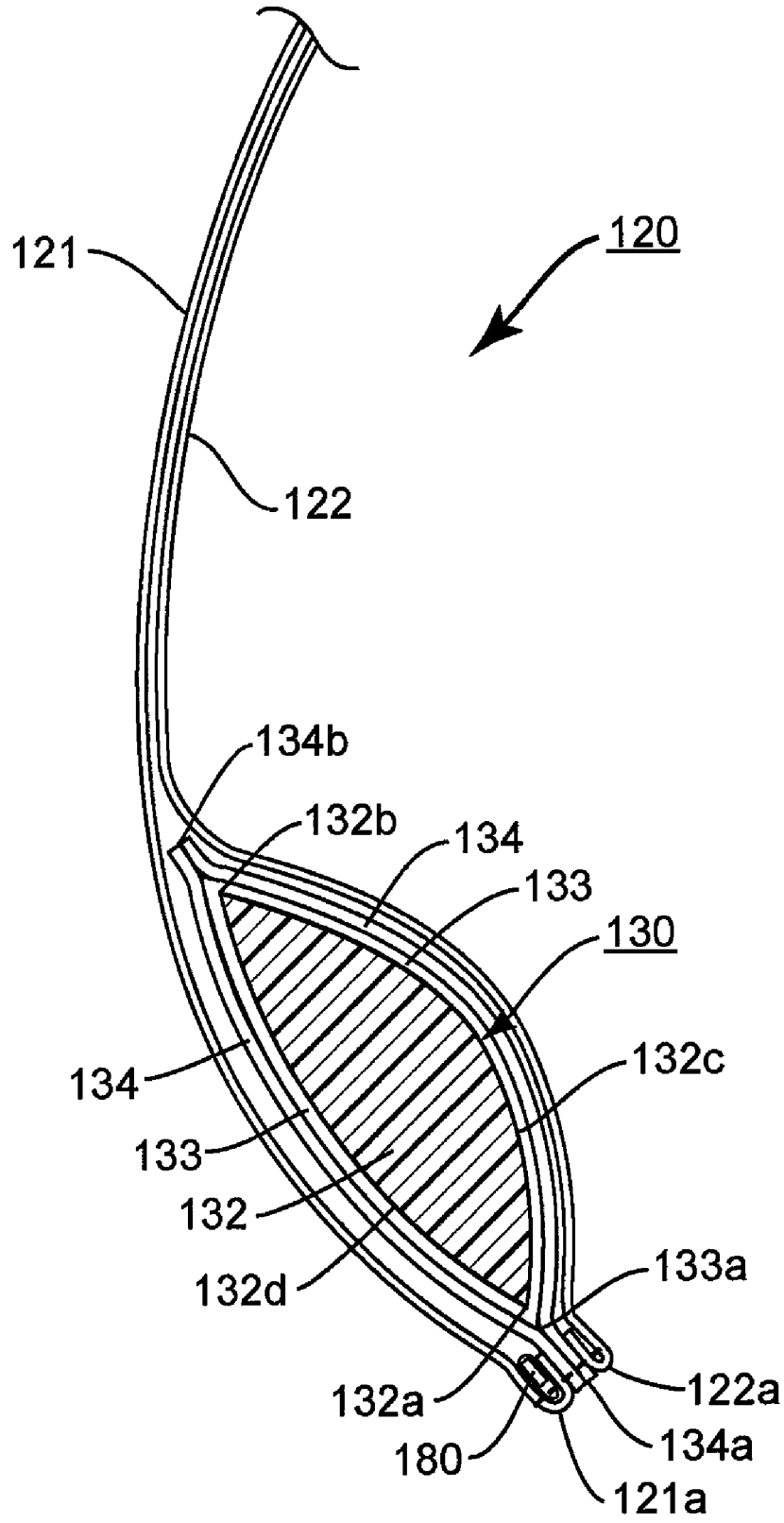
FIG. 3 is a cross-sectional view of the brassiere of FIG. 1 taken along Line III-III.

Referring to FIG. 3, a cross-sectional view (taken along Line III-III of FIG. 1) of one embodiment of the brassiere cup 120 of the present invention is illustrated. As shown in the Figure, the brassiere cup 120 comprises an outer fabric layer 121 having a lower peripheral portion 121*a*, and an inner liner fabric layer 122 having a lower peripheral portion 122*a*. Both outer fabric layer 121 and inner liner fabric layer 122 are stretch fabrics molded in the shape of a cup by conventional molding processes; however, fabric layers 121 and 122 are not attached to one another across substantially all of their inner surface areas, but only around the peripheries of each cup. This provides a lightweight, non-rigid cup construction, which gives the breasts a natural shape and appearance.

In one embodiment, the outer fabric layer 121 comprises a knitted blend of polymeric or polyamide yarns and elastomeric yarns, such as nylon and spandex. Without limiting the outer fabric layer 121 to specific knitted blend, it has been found that a blend of greater than about 75 percent (by weight) nylon and less than about 25 percent (by weight) spandex provides a suitable lightweight outer fabric layer 121. For example, in one brassiere cup 120 construction, a knitted blend of 76.5 percent nylon and 23.5 percent spandex provides a desirable lightweight outer fabric layer 121 having a weight of less than about 7.5 ounces per square yard. A lightweight outer fabric layer 121 construction such as this can be knitted as a lace, if desired. An inner liner layer 122 is provided, having a lightweight, soft hand, which provides comfort when in direct contact with the wearer's breast. Without limiting the inner liner layer 122 to a specific knitted blend, it has been found that a blend of greater than about 90 percent (by weight) nylon and less than about 10 percent (by weight) spandex provides a suitable inner liner fabric layer 122. For example, in one brassiere cup 120 construction, a knitted blend of 94 percent nylon and 6 percent spandex provides a desirable lightweight inner liner fabric layer 122 having a weight of less than about 9.5 ounces per square yard.

Referring again to FIG. 3, in this embodiment, the brassiere cup 120 construction of the present invention includes a breast enhancement insert 130 which is positioned between the outer fabric layer 121 and the inner liner layer 122. The breast enhancement insert 130 is pre-constructed and comprises a shaped padding material 132 having a lower peripheral portion 132*a* and an upper peripheral portion 132*b*. Exemplary shapes of the breast enhancement insert 130 are discussed in greater detail below.

In one embodiment, the padding material comprises a polyurethane foam; however, other pliable padding materials such as a polyester fiber filler or shaped gels could be used as the padding material 132. Alternatively, in some applications a shaped air pouch could be used. Encapsulating the shaped foam 132 are first encapsulating fabric layers 133, which are laminated to the inner and outer surfaces 132*c* and 132*d* of the foam 132 either by adhesives or thermal bonding. In this embodiment, the fabric laminated to the foam 132 inner and outer surfaces 132*c*, 132*d* comprises a knitted blend of polymeric and elastomeric yams. Without limiting the first encapsulating layers 133 to a specific knitted blend, it has been found that a blend of greater than about 90 percent (by weight) polyester and less than about 10 percent (by weight) spandex provides a suitable first encapsulating fabric layer 133. For example, in one brassiere cup 120 construction, a knitted blend of 94 percent polyester and 6 percent spandex provides a desirable lightweight encapsulating fabric layer 133 having a weight of less than about 3.5 ounces per square yard. This provides a pliable and lightweight layer, which complements the pliability of the underlying foam 132.

Figure 4:
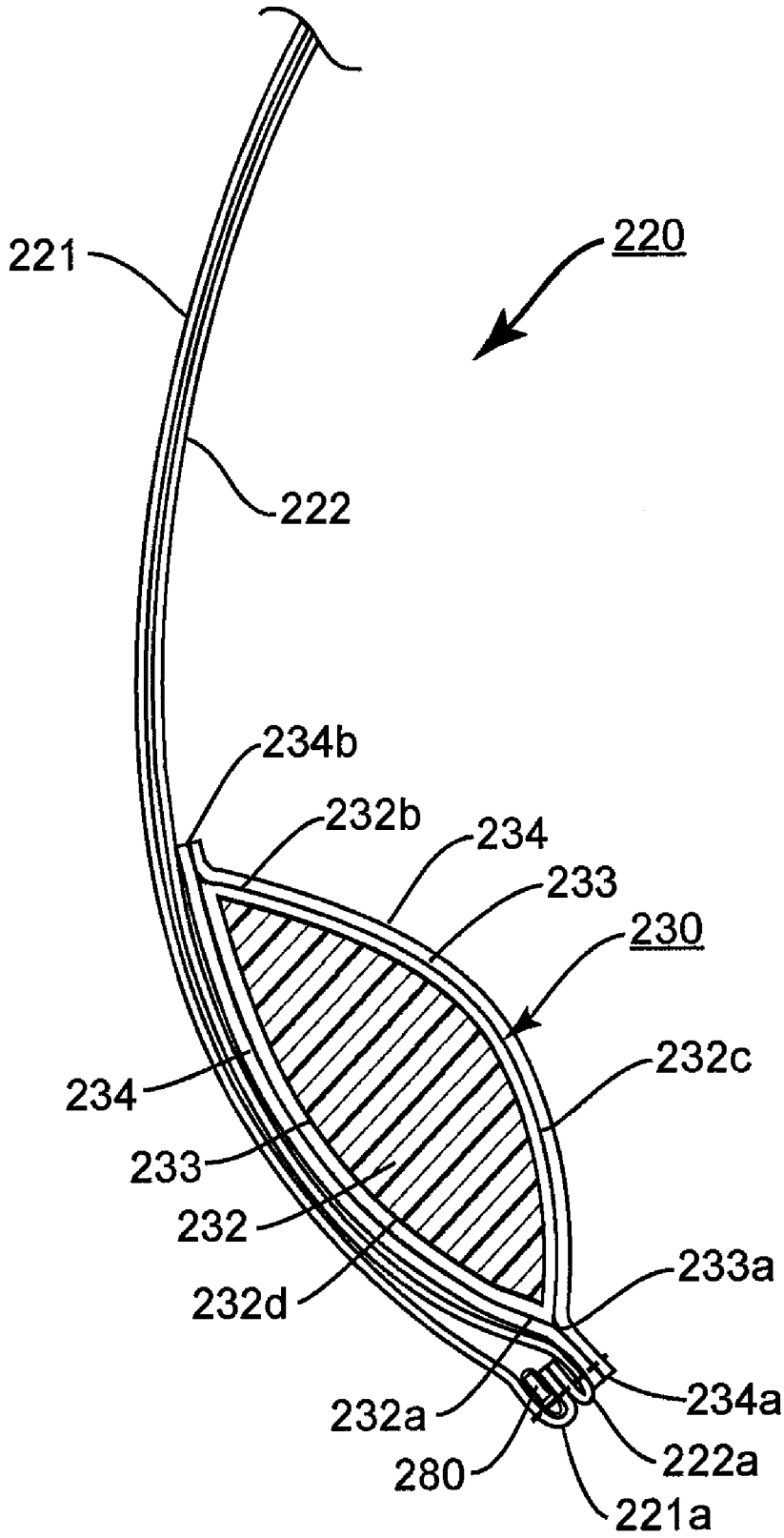
FIG. 4 is a cross-sectional view of an alternative embodiment of the brassiere incorporating the breast enhancement insert of the present invention.

Optionally, in an alternative embodiment, second fabric layers 134 are laminated over the first encapsulating fabric layers 133 on each of the inner and outer sides 132*c* and 132*d* of the foam 132. These optional second fabric layers 134 may be provided for several reasons, such as to provide an improved margin/flange 134*a*, discussed below, and to provide a sufficient thickness of fabric to mask the yellowing of the foam over time, when polyurethane foam is used as the padding material. The second fabric layers 134 also comprise a knitted blend of polymeric and elastomeric yams. Without limiting the second fabric layers 134 to a specific knitted blend, these layers also have a knitted blend of greater than about 90 percent (by weight) polyester and less than about 10 percent (by weight) spandex. For example, in one brassiere cup 120 construction, a knitted blend of 93 percent polyester and 7 percent spandex having a weight of less than about 3.6 ounces per square yard, also providing a pliable, lightweight layer. As shown in FIGS. 3 and 4, the lower edges of second fabric layers 134 extend downwardly beyond the lower edge 133*a* of the encapsulated foam, and outwardly from the outermost edge 133*b* of the insert 130, to form a margin/flange 134*a* for attaching the breast enhancement insert 130 inside of the brassiere cup 120. If the optional second fabric layers are not included, then the lower edges of layers 133 will be extended downwardly beyond the lower edge 132*a* of the foam 132 to create the margin.

Figure 5:
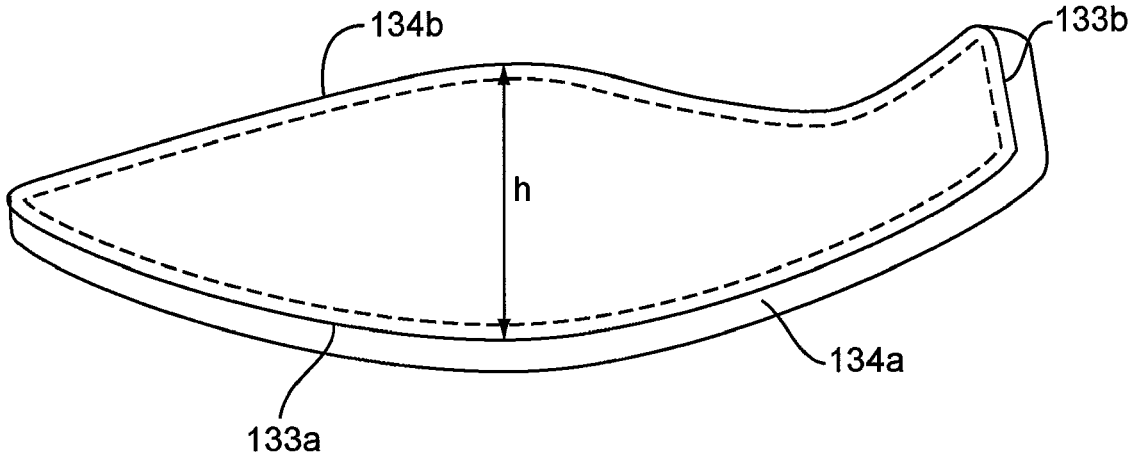
FIG. 5 is a rear view of the breast enhancement insert of the present invention.
Figure 6:
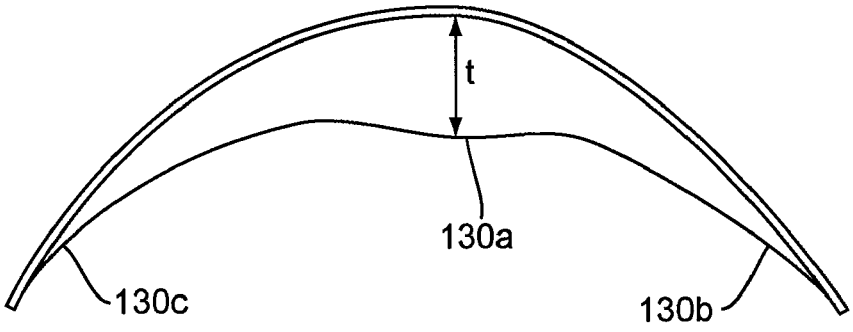
FIG. 6 is a top view of the breast enhancement insert of FIG. 4.

Turning now to FIGS. 5 through 8, the breast enhancement insert 130 can be seen with greater specificity. Shown in FIG. 5 is an elevational view of one embodiment of the breast enhancement insert 130 for the right brassiere cup 120. As will be appreciated, the breast enhancement insert 130 for the left brassiere cup 120 is a mirror image. FIGS. 6 provides a top view of the breast enhancement insert 130. FIGS. 5 and 6, when viewed in conjunction with FIGS. 1 and 2, illustrate the shaped structure of the encapsulated foam 132. As shown in these Figures, at region 130*a* of the insert 130, the padded foam 132 has a thickness, t, and a height, h, that is greater than the thickness and height at the tapered outer region 130*b* and the tapered inner region 130*c*. When attached between the outer fabric layer 121 and the inner liner layer 122, as best shown in FIGS. 1 and 2, regions 130*a*, 130*b*, and 130*c* lift the breast within the brassiere cup 120, thus reducing the effect of gravity on the breast, while enhancing the shape of the breast.

Figure 7:
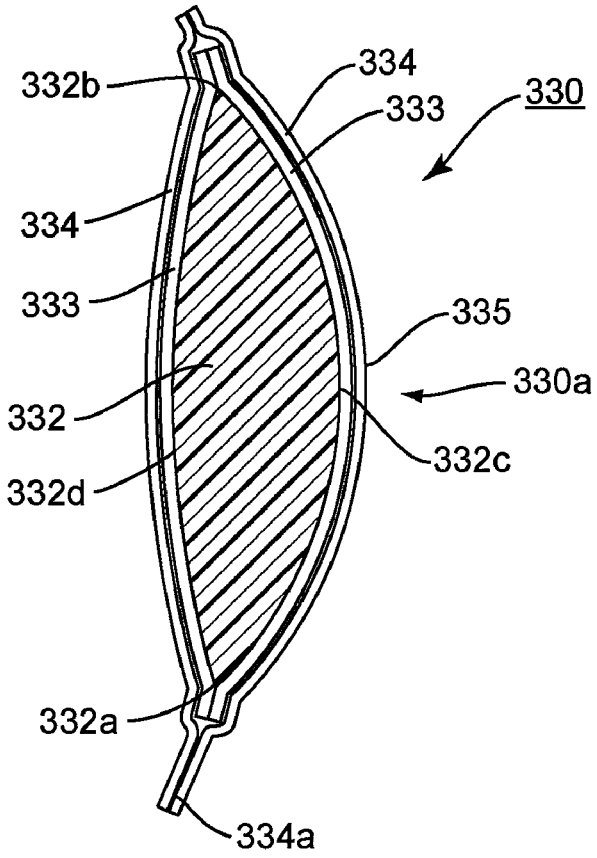
FIG. 7 is a cross-sectional view of one embodiment of the breast enhancement insert of the present invention.
Figure 8:
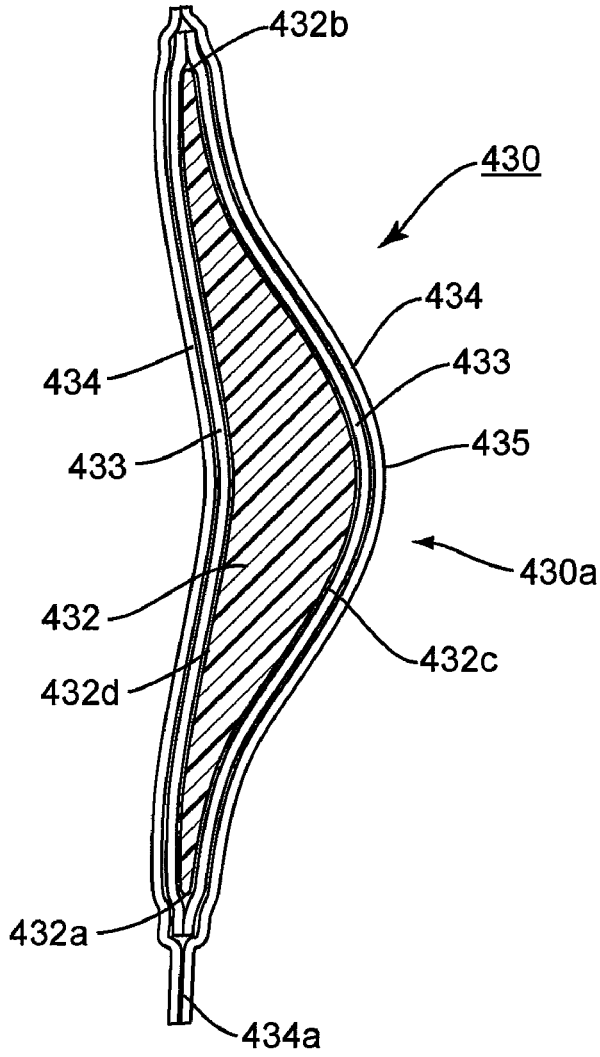
FIG. 8 is a cross-sectional view of an alternative embodiment of the breast enhancement insert of the present invention.

FIGS. 7 and 8 are illustrative of two exemplary cross-sections of the breast enhancement insert 130. As shown in FIG. 7, the inner surface 335 of breast enhancement insert 330 is symmetrically convex across its entire surface area at region 330*a*. The inner surface 435 of the breast enhancement insert 430 of FIG. 8 is also symmetrical across the entire surface area at region 430*a*, resembling a bell curve. It has been found that geometries such as these, that are symmetrical, or substantially symmetrical, in this region 330*a*, 430*a* of the insert 330, 430 provide the most desirable enhancement of the breast in brassiere cup 120. The choice of a particular geometry is dependent upon the desired degree of lift, the type and style of brassiere, etc. As will be appreciated by those skilled in the art, the actual size of a breast enhancement insert 130, 230, 330, 430 will vary with the size of the brassiere cup 120. Thus a larger brassiere cup will have a proportionally larger insert.

Returning to FIG. 3, the actual construction of the brassiere cup 120 is best illustrated. The margin 134*a*, or flange, that extends downwardly and outwardly from the second fabric layers 134 of the insert 130 provides the material for either stitching or adhering the insert 130 inside the brassiere cup 120. In the embodiment shown, the margin 134*a*, the lower periphery 121a of the outer fabric layer 121, the lower periphery 122*a* of the inner liner layer 122, and a fabric encased underwire 180 are simultaneously stitched together at the lower periphery of the brassiere cup 120. As will be appreciated by those skilled in the apparel arts, once the stitching operation is completed, layers 121 and 122 are turned inside out, so that no stitching is visible at the lower periphery of the brassiere cup 120. The fabric encased underwire 180 provides supplemental support and shaping for the brassiere cup 120; however, alternatively, a frame also could be employed. Constructed in this manner, the breast enhancement insert 130 is attached only along the length of the margin 134*a*, leaving the upper periphery of the insert 130 as an unattached free end 134*b*, which permits pivotal movement of the insert 130 between the unattached stretchable layers 121 and 122 which form the cup. This affords flexibility within the stretchable cup, while providing lift and enhancement to the wearer's breasts.

Turning to FIG. 4, an alternative construction of the brassiere cup 220 is shown. In this embodiment, the insert 230, which is formed in the same manner as described above, is positioned inside the formed cup, for direct contact with the wearer's breast. Again, the margin 234*a*, or flange, that extends downwardly and outwardly from the second fabric layers 234 of the insert 230 provides the material for either stitching or adhering the insert 130 inside the brassiere cup 220. In the embodiment shown, the margin 234*a*, the lower periphery 221*a* of the outer fabric layer 221, the lower periphery 222*a* of the inner liner layer 222, and a fabric encased underwire 280 are again simultaneously stitched together at the lower periphery of the brassiere cup 120. Alternatively, the margin 234*a* may be folded under and stitched between the lower peripheries 221*a* and 222*a* so that the stitching is not visible. Again, also, the breast enhancement insert 230 is attached only along the length of the margin 234*a*, leaving the upper periphery of the insert 230 as an unattached free end.

The invention has been described herein in terms of several embodiments and constructions that are considered by the inventor to represent the best mode of carrying out the invention. It will be understood by those skilled in the art that various modifications, variations, changes and additions can be made to the illustrated embodiments without departing from the spirit and scope of the invention. These and other modifications are possible and within the scope of the invention as set forth in the claims.

We claim:

1. A brassiere cup for enhancing the shape of a breast, comprising:

(a) an outer fabric layer having a lower peripheral portion;

(b) an inner liner fabric layer having a lower peripheral portion;

(c) a breast enhancement insert comprising:

(i) a padding material having inner and outer surfaces, the inner and outer surfaces encapsulated within a fabric cover;

(ii) upper and lower peripheral portions;

(iii) inner and outer surfaces; and the lower peripheral portion of the breast enhancement insert attached along the lower peripheral portions of the outer fabric layer and the inner liner fabric layer, the upper peripheral portion and the inner and outer surfaces of the insert substantially unattached so that the insert is moveable and above the lower peripheral portion.

2. The brassiere cup of claim 1 wherein the outer fabric layer and the inner liner layer each comprise a knitted blend of nylon and elastomeric yarns.

3. The brassiere cup of claim 1 wherein the outer fabric layer and the inner liner layer are molded to form a cup shape.

4. The brassiere cup of claim 1 wherein the outer fabric layer and the inner liner layer each have a weight of less than about 9.5 ounces per square yard.

5. The brassiere cup of claim 1 wherein the breast enhancement insert has a curvilinear shaped lower peripheral portion.

6. The brassiere cup of claim 1 wherein the padding material is a shaped foam.

7. The brassiere cup of claim 6 wherein the shaped foam is polyurethane.

8. The brassiere cup of claim 7 wherein the fabric cover encapsulating the polyurethane comprises a first fabric layer laminated to each of the inner and outer surfaces of the polyurethane.

9. The brassiere cup of claim 8 wherein the fabric layer laminated to each of the inner and outer surfaces of the polyurethane comprises a knitted blend of polyester and elastomeric yarns.

10. The brassiere cup of claim 8 further comprising a second fabric layer laminated to the first fabric layer on each of the inner and outer surfaces of the polyurethane.

11. The brassiere cup of claim 10 wherein the second fabric layer laminated to the first fabric layer comprises a knitted blend of polyester and elastomeric yarns.

12. The brassiere cup of claim 1 wherein the breast enhancement insert is positioned between the outer fabric layer and the inner liner layer.

13. The brassiere cup of claim 1 wherein the breast enhancement insert is positioned adjacent the inner liner fabric layer for direct contact with the wearer's breast.

14. The brassiere cup of claim 1 further comprising a flange along the lower peripheral portion of the breast enhancement insert for attachment along the lower peripheral portions of the outer fabric layer and inner liner fabric layer.

15. The brassiere cup of claim 1 further comprising a rigid support positioned adjacent the lower peripheral portions of the outer fabric layer and the inner liner layer.

16. The brassiere cup of claim 15 wherein the rigid support is an underwire.

17. A brassiere comprising;

(a) a pair of breast cups, each of the breast cups comprising:

(i) an outer fabric layer having a lower peripheral portion;

(ii) an inner liner fabric layer having a lower peripheral portion;

(iii) a breast enhancement insert comprising:

a padding material having inner and outer surfaces, the inner and outer surfaces encapsulated within a fabric cover;

upper and lower peripheral portions;

inner and outer surfaces;

the lower peripheral portion of the breast enhancement insert attached along the lower peripheral portions of the outer fabric layer and the inner liner fabric layer, the upper peripheral portion and the inner and outer surfaces of the insert substantially unattached so that the insert is moveable and above the lower peripheral portion;

(b) a pair of backstraps, one of the pair of backstraps connected to one of the pair of breast cups, and the other of the pair of backstraps connected to the other of the pair of breast cups; and (c) a pair of shoulder straps, one of the pair connecting one of the pair of breast cups to one of the pair of backstraps, and the other of the pair of shoulder straps connecting the other of the pair of breast cups to the other of the pair of shoulder straps.

18. The brassiere of claim 17 wherein the outer fabric layer and the inner liner layer each comprise a knitted blend of nylon and elastomeric yarns.

19. The brassiere of claim 17 wherein the outer fabric layer and inner liner layer are molded to form a cup shape.

20. The brassiere of claim 17 wherein the outer fabric layer and the inner liner layer each have a weight basis of less than about 9.5 ounces per square yard.

21. The brassiere of claim 17 wherein the breast enhancement insert has a curvilinear shaped lower peripheral portion.

22. The brassiere of claim 17 wherein the padding material is a shaped foam.

23. The brassiere of claim 22 wherein the shaped foam is polyurethane.

24. The brassiere of claim 23 wherein the fabric cover encapsulating the polyurethane comprises a first fabric layer laminated to each of the inner and outer sides of the polyurethane.

25. The brassiere of claim 24 wherein the fabric layer laminated to each of the inner and outer surfaces of the polyurethane comprises a knitted blend of polyester and elastomeric yarns.

26. The brassiere of claim 24 further comprising a second fabric layer of fabric laminated to the first fabric layer on each of the inner and outer surfaces of the polyurethane.

27. The brassiere of claim 26 wherein the second fabric layer laminated to the first fabric layer comprises a knitted blend of polyester and elastomeric yarns.

28. The brassiere of claim 17 wherein the breast enhancement insert is positioned between the outer fabric layer and the inner liner layer.

29. The brassiere of claim 17 wherein the breast enhancement insert is positioned adjacent the inner liner fabric layer for direct contact with the wearer's breast.

30. The brassiere of claim 17 further comprising a flange along the lower peripheral portion of the breast enhancement insert for attachment along the lower peripheral portions of the outer fabric layer and inner liner fabric layer.

31. The brassiere of claim 17 further comprising a rigid support positioned adjacent the lower peripheral portions of the outer fabric layer and the inner liner layer.

32. The brassiere of claim 31 wherein the rigid support is an underwire.

* * * * *